United States Patent [19]

Adler

[11] 4,227,326

[45] Oct. 14, 1980

[54] AMUSEMENT DEVICE

[76] Inventor: Alan J. Adler, 752 La Para Ave., Palo Alto, Calif. 94306

[21] Appl. No.: 964,198

[22] Filed: Nov. 28, 1978

[51] Int. Cl.[3] ..... G09F 11/14; G03B 25/00

[52] U.S. Cl. ..... 40/527; 40/399; 46/36; 352/99

[58] Field of Search ..... 40/399, 524, 525, 526, 40/527, 528; 46/34, 36; 352/98, 99

[56] References Cited

U.S. PATENT DOCUMENTS

| | | | |
|---|---|---|---|
| 385,838 | 7/1888 | Boussemaere | 40/527 |
| 394,498 | 12/1888 | Miller | 40/527 |
| 684,185 | 10/1901 | Buechner | 40/399 |
| 1,466,252 | 8/1923 | Shaw | 352/99 |
| 2,354,769 | 8/1944 | O'Kane | 40/399 |
| 2,519,181 | 8/1950 | Freiberg | 40/399 |
| 2,888,932 | 6/1959 | Freiberg | 40/399 |
| 3,740,128 | 6/1973 | Adler | 352/99 |
| 4,160,337 | 7/1979 | Fischer | 46/26 |

*Primary Examiner*—Paul J. Hirsch
*Attorney, Agent, or Firm*—Christie, Parker & Hale

[57] ABSTRACT

An amusement device for use by children both for entertainment as well as a coordination aid. The device comprises a plurality of thin essentially similar segments, each segment pivotally engaging adjacent segments in snap-in relation. The pivotal engagement enables rotation of one segment with respect to an adjacently engaged segment through a predetermined angle. Locking means are formed into the segments preventing translation of one segment with respect to another when such segments are engaged. When connected in the form of an open belt, the device may be manipulated in various entertaining manners, and upon articulation, the impact of adjacent segments produces a slapping sound for additional amusement. When the free ends of the belt arrangement are engaged to form a closed loop, two segment stacks are created. Back and forth manipulation of each segment stack causes individual segments to move from one stack to the other. Additionally, by providing indicia such as pictures, perforations, and patterns on each segment face, a changing visual display is obtained as the segments are articulated from one stack to the other.

24 Claims, 14 Drawing Figures

Fig. 1
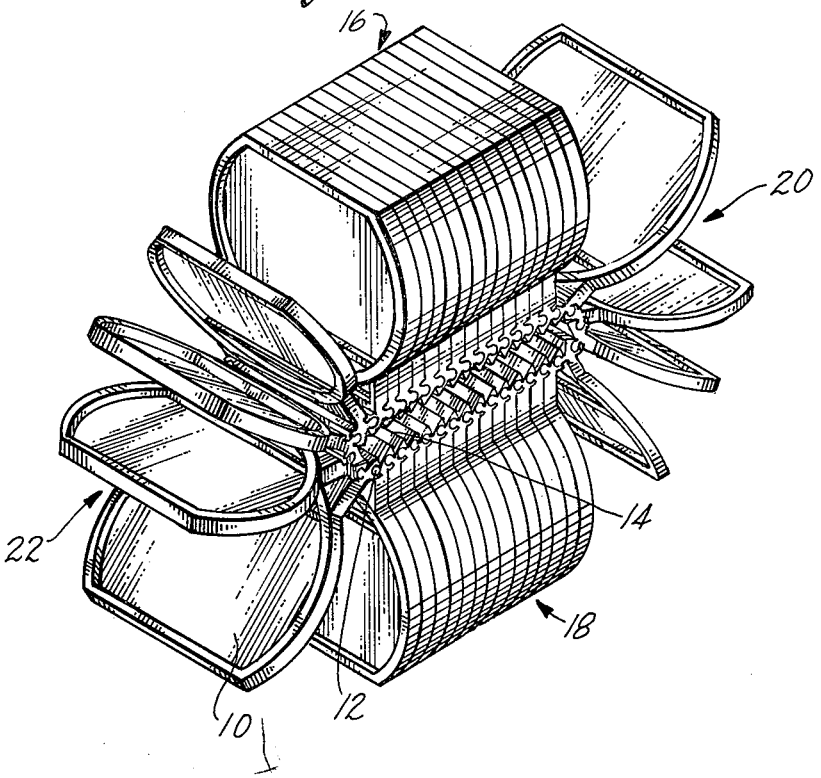
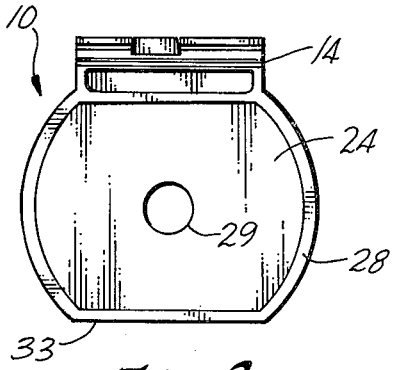
Fig. 2
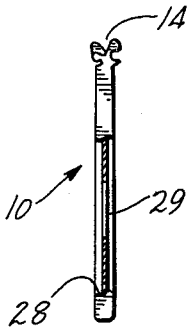
Fig. 3

Fig. 4
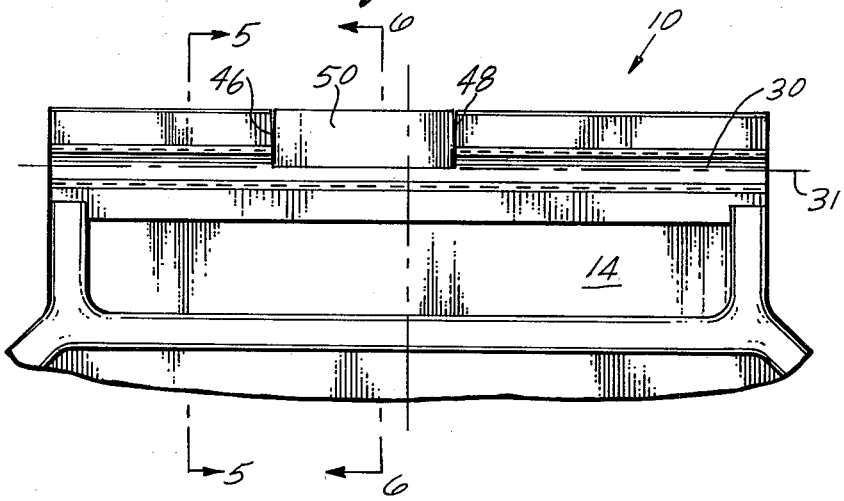
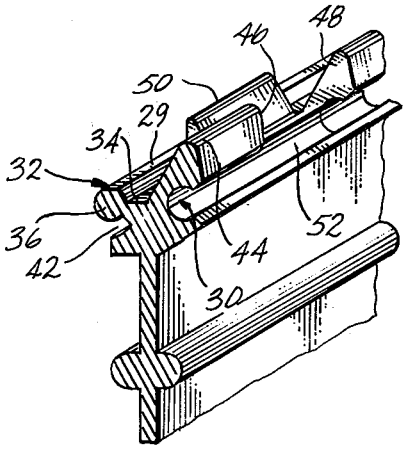
Fig. 5
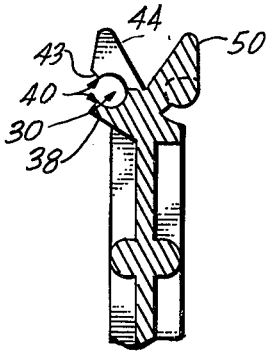
Fig. 6

AMUSEMENT DEVICE

BACKGROUND OF THE INVENTION

1. Field of the Invention: This application relates to amusement devices and more particularly to a device that includes a plurality of interconnected segments for articulation by a baby or young child.

2. Description of the Prior Art: Amusement devices having a plurality of essentially similar interconnected articulable segments are known in the art. One such device is described in U.S. Pat. No. 3,740,128. Operation of the described device relies upon the stringing together of plaques by means of a suitable elastic-type string placed through receiving holes in the base portions of the plaques. The attached plaques may be configured to form a stack, however, the plaques at each of the ends of the stack are normally not securable to each other. Additionally, the edges of the plaques opposite their bases are rounded and do not enable the string of plaques to be stood upright on these edges on a flat surface.

One other aspect of this prior art device is the permanent nature of the means by which adjacent plaques of the preferred embodiment of the prior art device are attached. Thus, a user normally can not separate the plaques of the device and then reassemble them. Since the segments are permanently secured to each other, the manipulative skill development to be realized from the "snap-in" engaging and disengaging of device segments is lost.

One embodiment of the described prior art device does use snap-in type securement sockets between adjacent plaques. However, the sockets and pins are located at one corner of the base portion of the plaque or segment resulting in a very unsecure connection. Even very low twisting forces on the segments tend to cause them to uncouple.

Additionally, the pin and socket arrangement is difficult for children to assemble. Children generally find it troublesome to establish proper alignment of the pins and sockets while, at the same time, applying the necessary coupling force to join the plaques.

The pin and socket arrangement is also difficult to manufacture since designs of this type are not readily adaptable to injection molding techniques.

SUMMARY OF THE INVENTION

The present invention is directed toward an amusement device for use by children, both for entertainment and educational purposes. The device comprises a plurality of thin planar segments, each segment having a pair of opposed faces, an elongated base portion defining one edge of the planar segment, and an elongated flat edge located at the side of the segment opposite the base portion. Means on each segment are provided for detachably engaging the base portion with adjacent segment base portions. The engaging means pivotally interconnect adjacent segments to thereby define an axis of rotation of the segments between a position of face-to-face abutment and a position of angular separation of adjacent segments. Finally, means are provided on each segment for preventing translation of engaged segments along the axis.

Engagement of adjacent segments is accomplished by means of a snap-in fit between a protruding rib of one segment and the socket of an adjacent segment. In the engaged condition, the segments are rotatable from an abutting position to a predetermined angle of separation. The angle of separation is fixed by contact of a base extension portion of one segment with the side of a rib of an adjacently engaged segment.

To prevent translation of one segment along the axis of the socket of an adjacently engaged segment, a tab formed in the rib portion is located in registration with a complementary gap in the base extension portion of an adjacently engaged segment. Consequently, for all angles of rotation of the adjacently engaged segments, the tab portion extends into the gap of such adjacently engaged segments so as to prevent translation of one segment with respect to the other.

By interconnecting all the segments in a string of a sufficiently large number of segments, a closed belt configuration is obtained. The user, by moving stacked segment portions of the closed belt back and forth causes the segments to rapidly transfer from one stack to the other. Upon contact of one segment with an adjacent segment, a slapping sound is caused to occur. Such sounds provide entertainment and distraction for young children as they amuse themselves with the device.

The side of each segment opposite the base portion is truncated to provide a surface or edge parallel to the base portion of the segment. Such a truncated edge allows the device to support itself on a relatively flat surface and to be moved along in a "tank-track" fashion on such surface. The flattened edge configuration also enables a closed loop configuration of segments to self propel, i.e. "walk" down an inclined flat surface.

An educational aspect of the device resides in snap action technique for the joining and disengaging adjacent device segments. The device segments are readily aligned and urged into connection with little effort and force. The snap action feature thus enables children to use the device in a manner which developes and enhances their manipulative skills and dexterity.

BRIEF DESCRIPTION OF THE DRAWINGS

FIG. 1 is a perspective view of an amusement device connected in an endless loop.

FIG. 2 is an elevation view of the amusement device segment.

FIG. 3 is a side view, partially in section, of the amusement device segment.

FIG. 4 is an enlarged view of the base portion of a segment.

FIG. 5 is a perspective sectional view of the base portion of segment taken along line 5—5 of FIG. 4.

FIG. 6 is a sectional view of the base portion taken along line 6—6 of FIG. 4.

DETAILED DESCRIPTION

Figure 7A:
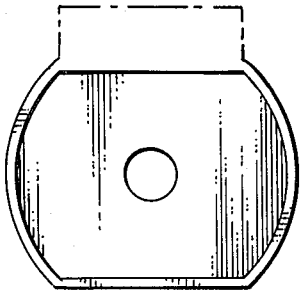
FIGS. 7A–7E are elevation views of the device segment illustrating examples of face portion indicia.
Figure 7B:
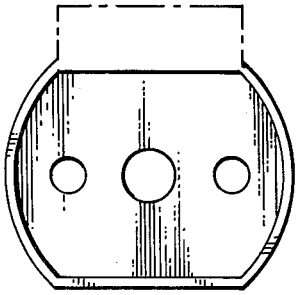
Figure 7C:
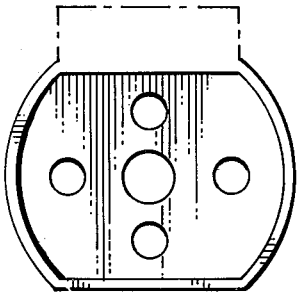
Figure 7D:
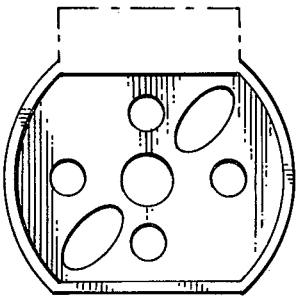
Figure 7E:
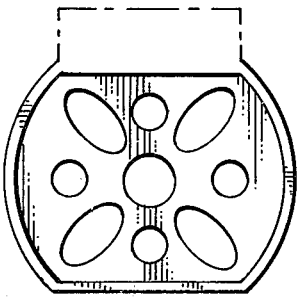

Referring to FIG. 1, there is shown in perspective view the improved amusement device of the herein described invention comprising a plurality of essentially similar thin planar segments 10 united to adjacent segments by means of snap-together joints 12 located at the base portion 14 of each segment.

When many of such segments are engaged into a belt-like combination having two free ends, a user may, by gripping and manipulating each free end, cause the segments to articulate from one formed stack to another in various arbitrary manners in which the user will delight. When many of such segments are engaged to form and endless closed belt, the amusement device may be manipulated in various manners to form the belt in circular or oblong configurations and to "fan" the segments at each end at different angles. One engaging in use of the device, typically a young child, finds entertainment and amusement in attempting to attain various shapes and articulating the device segments once a particular shape is obtained.

As an example, the oval-shaped configuration of FIG. 1 has two groups of segments 16 and 18 arranged in two opposite stacks, said stacks are joined by several segments forming the curved parts 20 and 22 at each end of the oval. As the user applies an axial movement force in the direction towards the curved end 20 or 22 of the oval, the segments will articulate from one stack to the other about each curved end. Thus, in "tank-track" fashion, the device moves with a linear motion on a flat surface when used as just described and self propels down an inclined surface under the influence of gravity.

Additionally, upon articulation of such segments, a slapping impact sound results when segments previously in the curved ends 20 and 22 rotate into contact with segments in stacked portions 16 and 18. This slapping sound provides entertainment and diversion for such users and is variable in loudness intensity based upon the speed at which the device is manipulated.

Additional entertainment and amusement value in the device is found by alternating indicia upon the faces 24 of segment 10. Examples of such indicia are sequential photographs depicting motion of some person or object as the individual segments are articulated. Design patterns are another such example of possible indicia. FIGS. 7A through 7E illustrate for the presently preferred embodiment such design variations. Each indicia is defined by a pattern of perforations through the face portion 24 and further defined by having all the segments having the same patterns formed from material of the same color. Thus, FIG. 7A may be a red color, FIG. 7B may be an orange color, etc.

Referring now to FIG. 2 and FIG. 3, there is illustrated in front view and side view respectively, segment 10 formed from a thin piece of nonbreakable resilient material. In the preferred embodiment, any one of a class of resilient, thermoplastic materials is suitable for the segments such as polypropylene, polystyrene, or polyethylene.

Segment 10 has two opposed face portions 24 and an elongated base portion 14. Extending around the periphery of segment 10 on both sides thereof is a raised edge 28 defining a rim extending transversely of and beyond the plane of face portion 24 on each side of the segment. The slapping sound previously discussed is generated upon forceful impact contact of the edges 28 of adjacent segments. For the segment illustrated in FIG. 2, indicia 29 is simply a circular perforation through the face portion 24. So that the device may be placed in an upright position for articulation in a linear manner along a flat surface, the circular outline of segment 10 is truncated at the edge opposed to the base portion 14, thereby forming surface contact edge 33 parallel to base portion 14.

Referring now to FIG. 4, there is shown an enlarged view of base portion 14 of segment 10. FIG. 5 is a sectional view in perspective of the base portion 14 taken along line 5—5 of FIG. 4, and FIG. 6 is a sectional view of the base portion 14 taken along line 6—6 of FIG. 4. Base portion 14 includes an elongated socket 30 having a circular cross-section which extends along the length of the base portion 14. A protruding rib 32 is located on the side of the base portion 14 opposite socket 30. Rib 32 extends along the length of the base portion 14 and has a leg portion 34 that juts out at an angle from the base portion 14. Socket 30 and rib 32 act as the female and male portions respectively of a flexible hinge or claw structure whereby adjacent segments are readily engaged and disengaged upon application of a predetermined amount of force. A generally cylindrical tip portion 36 is formed at the free end of rib 32. The radius of the tip portion 36 is made marginally smaller than the radius of the circular socket 30. Lips 38, 43 define the internal and external sides of socket 30 and extend outwardly about the socket to a point such that the distance across the socket opening 40 is slightly less than the diameter of cylindrical tip portion 36 to receive and hold tip portion 36 when it is snapped therein. An elongated extension 44 which is generally triangular in cross-section extends in a generally vertical direction upwardly from lip 43.

Interconnection of adjacent segments is accomplished by means of a snap-in action whereby the tip portion 36 is forced into the socket opening 40 of an adjacent segment. Since a resilient material is used in fabricating the segment 10, the sides of opening 40, that is, lip 38 and lip 43, bend and deform outwardly sufficient to allow the tip 36 to pass through opening 40, and thus the tip will be inserted into socket 30. Expressed in a different way, the sides of the female portion of the claw structure deflect to accept the male portion of the structure. The insertion of tip portion 36 in socket 30 is facilitated by a flattened area 39 which is imparted to the upper surface of tip portion 36. Lip 43 slides along surface 39 as the tip portion 36 is being inserted and withdrawn from socket 30.

Figure 8:
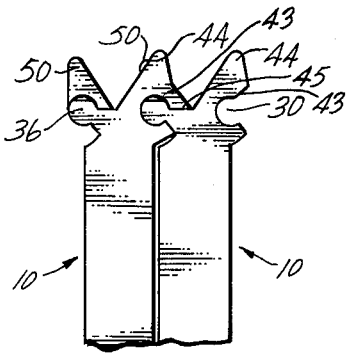
FIG. 8 is a side elevation view of two adjacently engaged segments in abutting relation.
Figure 9A:
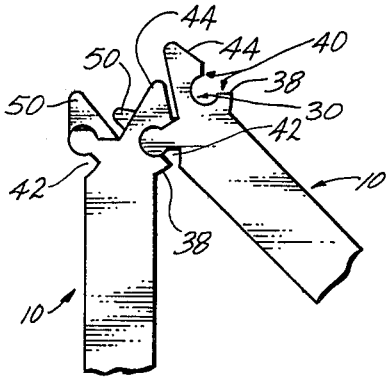
FIG. 9A is a side elevation view of two adjacently engaged segments rotated through a predetermined angle.
Figure 9B:
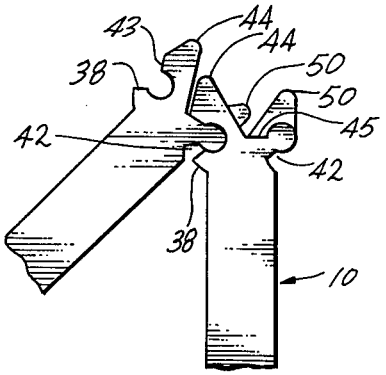
FIG. 9B is a side elevation view of two adjacently engaged rotated segments taken from the side thereof opposite FIG. 9A.

Referring now to FIG. 8, there is shown two adjacently engaged segments in abutting relation. In FIGS. 9A and 9B there is shown side elevation views taken from each side of a pair of engaged segments rotated to their maximum angle of separation. This angle of separation is determined by the contact of lip 43, which defines the external edge or side of socket 30 of one segment, with surface 45 on the upper side of leg 34 of an adjacent segment.

Because the radius of tip 36 is marginally less than the radius of socket 30, the tip 36 is free to rotate within the socket 30. Since opening 40 is slightly less than the diameter of tip 36, two engaged segments will not pull apart except upon application of an adequate separating force.

Recess 42 in base 14 provides clearance for lip 38 during the rotation of one segment with respect to an adjacently engaged segment. Upon rotation of one segment with respect to an adjacently engaged segment, surface 43 of one segment comes into contact with the side of rib 32 of an adjacently engaged segment, thereby limiting the arc of rotation between the engaged segments to a predetermined angle. In the preferred embodiment, the predetermined angle is in the range of 45°.

A slot 52 (FIG. 5) defined by walls 46 and 48 is located intermediate the ends of base extension portion 44, and as shown in FIG. 4, is located off center from the center line of segment 10. A tab 50, formed integrally with rib 32 and extending upwardly therefrom, is likewise located off center of the segment and is positioned in registration with slot 52 so that for all angles of rotations between the adjacently engaged segments, the tab 50 is bracketed by walls 46, 48. Such bracketing thus prevents translation of one segment with respect to an adjacently engaged segment along the axis 31 of socket 30. The off-center positioning of slot 52 and tab 50 enables the user to rapidly identify matching sides of adjacent segments. If the tab and slot of adjacent segments register, the rib of one segment is on the correct side to be snapped into the receiving socket of an adjacent segment.

While the basic principle of this invention has been herein illustrated along with one embodiment, it will be appreciated by those skilled in the art that variations in the disclosed arrangement, both as to its details and as to the organization of such details, may be made without departing from the spirit and scope thereof. Accordingly, it is intended that the foregoing disclosure and the showings made in the drawings will be considered only as illustrative of the principles of the invention, and not construed in a limiting sense.

What is claimed is:

1. An amusement device comprising:

a plurality of thin, planar segments, each segment having a pair of opposed faces, an elongated base portion defining one edge of the planar segment and an elongated flat edge located at the side of the segment opposite the base portion;

rib and socket means on the base of each segment for press fit engagement of the base portion of one segment with adjacent segment base portions, said rib and socket means pivotally interconnecting adjacent segments thereby defining an axis of rotation of said segments between a position of face to face abutment and a position of angular separation of adjacent segments; and means on each segment for preventing translation of engaged segments along the axis.

2. An amusement device according to claim 1 wherein the means for press fit engagement on each segment comprises:

an elongated protruding rib having a leg portion extending from the base portion and a generally cylindrical tip portion formed at the free end of the leg portion, said rib extending along the length of the base portion; and a generally circular elongated socket located on the side of the base portion opposite the rib, the socket extending along the length of the base portion, said socket having deflectable sides to receive in snap-in relation and for rotation therein the protruding rib of an adjacent segment.

3. An amusement device according to claim 2 wherein the elongated socket comprises an elongated upper and an elongated lower lip defining the external and internal side, respectively, of the socket on each segment, said upper lip being adapted to contact in abutting relation the external side of the rib on an adjacently engaged segment to define the limit of rotatable angular separation when such segments are rotated relative to each other.

4. An amusement device according to claim 3 wherein the means for preventing translation comprises:

an elongated extension formed in the base portion and extending outwardly thereof between the rib and the socket;

a gap in the elongated extension; and a tab offset from the extension extending outwardly from the base portion and extension in registration with the gap such that for all angles of rotation of the adjacently engaged segments the tab of one segment extends into the gap of an adjacent engaged segment so as to prevent relative translation of said engaged segments.

5. An amusement device according to claim 4 including a sufficient number of the segments which, when interconnected at the detachable engaging means, form a closed loop.

6. An amusement device according to claim 4 wherein the flat edges of each segment are parallel to the base portions, said edges enabling the device to be self-supporting on a flat surface.

7. An amusement device according to claim 1 wherein each planar segment includes a portion thereof recessed from the plane of the faces.

8. An amusement device according to claim 7 wherein the recessed portion is a central web enclosed by a thin transverse rim extending transversely of and beyond the plane of the central web on both sides thereof.

9. An amusement device according to claim 1 including indicia provided on the face portions of each segment.

10. A device according to claim 9 wherein the indicia are perforations in said face portions, said perforations being of a predetermined shape and distribution.

11. A device according to claim 9 wherein the indicia is pictorial matter; the pictorial matter being arranged in a predetermined sequence from segment to segment.

12. A device according to claim 9 wherein the indicia is a pattern of a predetermined configuration arrangement sequence from segment to segment.

13. A device according to claim 9 wherein the indicia are arranged sequentially from segment to segment to provide a changing visual impression as the segments are articulated.

14. An amusement device segment comprising:

a flat element having two parallel face portions;

an elongated base portion located at one side of the element and an elongated flattened edge located at the side of the element opposite the base portion comprising:

(A) an elongated protruding rib having a generally cylindrical tip portion formed into the free end thereof, (B) a generally circular elongated socket having deflectable sides located on the side of the base portion opposite the rib, said circular elongated socket adapted to receive in snap-in relation and for rotation therein the protruding rib of an adjacent segment, and (C) means for limiting the arc of rotation of the segment relative to an adjacent segment engaged therewith.

15. An amusement device segment according to claim 14 wherein the means for limiting the arc of rotation comprises an elongated upper and lower lip defining the external and internal side, respectively, of the socket, said upper lip being adapted to contact the external side of the rib of an adjacently engaged segment after rotation through a predetermined arc.

16. An amusement device segment according to claim 15 wherein the elongated flattened edge is parallel to the base portion to permit the segment to be supported on a flat surface when joined to with one or more additional segments comprising the device.

17. An amusement device segment according to claim 16 wherein the segment has a raised edge around the periphery thereof, said edge providing a slapping sound when impacted edgewise by a second segment.

18. An amusement device segment according to claim 15 including an elongated extension formed in the base portion and extending outwardly thereof between the rib and the socket, a gap in the elongated extension and a tab offset from the extension extending outwardly from the base portion and extension in registration with the gap such that for all angles of rotation of the adjacently engaged segments the tab extends into the gap of said engaged segment so as to prevent translation of one segment with respect to the other.

19. An amusement device segment according to claim 18 wherein the gap and tab are located to one side of a center line of the segment extending between the base portion and flattened edge to facilitate engagement of mating sides of adjacent segments.

20. A segment according to claim 19 wherein the segment is formed from resilient plastic material.

21. A segment according to claim 20 wherein the plastic material is a thermoplastic selected from the class consisting of polypropylene, polystyrene, and polyethylene.

22. An segment according to claim 14 including indicia provided on the face portions of the segment.

23. A device according to claim 10 wherein at least one perforation in each planar segment is located in registration with a perforation in each of the remaining planar segments.

24. A device according to claim 1 wherein at least one of the planar segments is of a different color than the remaining planar segment.

* * * * *